United States Patent [19]

Barclay et al.

[11] 4,161,432

[45] Jul. 17, 1979

[54] ELECTROPLATING CHROMIUM AND ITS ALLOYS

[75] Inventors: Donald J. Barclay, Winchester; William M. Morgan, Chandlers Ford, both of England

[73] Assignee: International Business Machines Corporation, Armonk, N.Y.

[21] Appl. No.: 913,973

[22] Filed: Jun. 8, 1978

Related U.S. Application Data

[63] Continuation-in-part of Ser. No. 913,639, Jun. 8, 1978, which is a continuation-in-part of Ser. No. 833,634, Sep. 15, 1977, abandoned, which is a continuation-in-part of Ser. No. 637,483, Dec. 3, 1975, Pat. No. 4,062,737.

[30] Foreign Application Priority Data

Jun. 14, 1977 [GB] United Kingdom ..... 24734/77

[51] Int. Cl.[2] ..... C25D 3/06

[52] U.S. Cl. ..... 204/51; 204/43 R; 423/366

[58] Field of Search ..... 204/51, 43 R, 43 T, 204/14 N; 423/366

[56] References Cited

U.S. PATENT DOCUMENTS

| | | | |
|---|---|---|---|
| 2,088,615 | 8/1937 | Schlotter | 204/51 |
| 2,822,326 | 2/1958 | Safranek | 204/43 R |
| 4,062,737 | 12/1977 | Barclay et al. | 204/43 R |

FOREIGN PATENT DOCUMENTS

| | | | |
|---|---|---|---|
| 1258021 | 12/1971 | United Kingdom | 204/51 |

OTHER PUBLICATIONS

D. J. Barclay et al., Inorganic Chemistry, vol. 9, No. 5, pp. 1024–1030, May 1970.

D. J. Levy et al., J. Electrochem. Soc., vol. 118, No. 10, pp. 1563–1570, Oct. 1971.

Paul Morisset et al., "Chromium Plating", p. 471 (1954).

D. J. Levy et al., Plating, pp. 1125–1131, Nov. 1970.

*Primary Examiner*—G. L. Kaplan

*Attorney, Agent, or Firm*—William N. Hogg

[57] ABSTRACT

A chromium or chromium alloy plating system and material are disclosed. The chromium is supplied by an aqueous equilibrated solution of a chromium (III) thiocyanate complex. A buffer material which also supplies one of the ligands to the chromium complex is provided. The buffer material is selected from amino acids, peptides, formates, acetates and hypophosphites.

32 Claims, No Drawings

ELECTROPLATING CHROMIUM AND ITS ALLOYS

DESCRIPTION

Related Applications

This is a continuation-in-part of application Ser. No. 913,639 filed June 8, 1978, entitled "Method of and Solution of Electroplating Chomium and Chromium Alloys and Method of Making the Solution," which in turn is a continuation-in-part of application Ser. No. 833,634, filed Sept. 15, 1977 entitled "Method of and Solution for Electroplating Chromium and Chromium Alloys and Method of Making the Solution," now abandoned, which in turn is a continuation-in-part of application Ser. No. 637,483, filed Dec. 3, 1975 entitled "Electrodeposition of Chromium," now U.S. Pat. No. 4,062,737.

BACKGROUND OF THE INVENTION

The present invention relates to the electroplating of chromium or a chromium-containing alloy.

In U.S. Pat. No. 4,062,737, there is described and claimed a chromium or chromium alloy electroplating solution in which the source of chromium comprises an aqueous solution of a chromium(III) thiocyanate complex and a process of plating chromium or a chromium-containing alloy comprising passing an electric plating current between an anode and a cathode in such a solution.

The preferred complexes described in said U.S. Pat. No. 4,062,737 are chromium(III) aquothiocyanate complexes prepared by equilibrating chromium perchlorate and sodium thiocyanate in an aqueous solution. The complexes so formed are described by the general formula:

$$((H_2O)_{6-n}Cr(III).(NCS)_n)^{(3-n)} \text{ where } n=1 \text{ to } 6$$

(Subscripts are always positive, but superscripts may be positive, negative or zero.)

In the specification of our copending application, Ser. No. 913,639, filed June 8, 1978, entitled: "Method of and Solution for Electroplating Chromium and Chromium Alloys and Method of Making the Solution," there is described and claimed a chromium or a chromium alloy electroplating solution in which the source of chromium comprises an aqueous solution of a chromium(III) thiocyanate complex having at least one ligand other than thiocyanate or water in the inner coordination sphere of the complex. Chromium(III) species in solution are ocatahedral with six ligands coordinated to the chromium atom. These ligands occupy and define the inner coordination sphere of the chromium atom and are inert inasmuch as they exchange very slowly with free ligands in the solution, e.g., the reaction:

$$(Cr(H_2O)_5(NCS))^{+2}+{}^*(NCS)^- \rightarrow (Cr(H_2O)_5{}^*(NCS))^{+2}+(NCS)^-$$

is very slow. It is the slowness of reactions of this type which complicates the chemistry of chromium(III) and necessitates equilibration at high temperatures. See the book by Basolo and Pearson, *Mechanism of Inorganic Reactions: Study of Metal Complexes in Solution,* published by Wiley. The linear thiocyanate anion, $NCS^-$, has unique catalytic properties through its ability to coordinate to metal ions through its nitrogen and sulphur atoms. Also, its electron density is extensively localized across the three atoms.

The thiocyanate anion is believed to catalyze the electron transfer reaction:

$$Cr(III)+3e^- \rightarrow Cr(0)$$

through the formation of multiple-ligand bridges between a thiocyanate Cr(III) complex and the surface of the cathode. The electro-active intermediate can be identified as:

Cr(III)-NCS-M where M is the metal surface of the cathode which is Cr(0) after an initial monolayer of chromium is plated. The "hard" nitrogen coordinates to the Cr(III) atom and the "soft" sulphur to the metal surface M of the cathode. Multiple-ligand bridging by thiocyanate in the electrochemical oxidation of chromium(II) at mercury electrodes is described in *Inorganic Chemistry* 9, 1024 (1970).

One embodiment of the invention described in our above-mentioned application Ser. No. 913,639 comprises a particularly advantageous chromium or a chromium alloy electroplating solution in which the source of chromium comprises an aqueous solution of a chromium(III) sulphatothiocyanate complex. More particularly, the chromium(III) sulphatothiocyanate complex comprises mixed chromium(III) thiocyanate complexes having the formula:

$$((H_2O)_{6-m-n}Cr(III)\ Cl_m\ (NCS)_n)^{3-m-n}$$

where m and n are both positive integers, but where m+n does not exceed six. Preparation of this aqueous solution of chromium(III) chlorothiocyanate complex was by equilibrating an aqueous solution of chromic chloride ($CrCl_3.6H_2O$) and sodium or potassium thiocyanate.

Commercially, chromium has been plated from aqueous chromic acid baths prepared from chromic oxide ($CrO_3$) and sulphuric acid. Such baths in which the chromium is in hexavalent form present a considerable health hazard as a result of the emission of chromic acid fumes. Further, if the plating current is interrupted for any reason, a deposit of unsatisfactory milky appearance is produced. In addition, delamination of the deposited chromium occurs. Thus, accidental interruption of the plating current can cause significant losses, and barrel chromium plating is rendered extremely difficult since it is difficult to apply more than very thin deposits of chromium and to ensure that the deposit covers and adheres to the articles to be plated.

Chromic acid plating baths have the further disadvantages that the plating efficiency is low and, therefore, the rate of deposition is low, the throwing power is limited, and it is difficult to deposit layers of uniform thickness over substantial areas. More metal is deposited on high current density areas, such as edges, and in certain circumstances, "burning" appears. It should also be noted that chromic acid plating baths contain a very high concentration of chromium, 100–200 grams per liter. However, since chromium salts are relatively expensive, the chromium concentration should be kept as low as possible to minimize the cost of making up the bath and to reduce "drag-out" on work pieces. The reduction in drag-out loss in making decorative chromium deposits is important since drag-out can amount to six or more times the weight of metal plated.

Numerous attempts have been made to use trivalent chromium salts to deposit chromium or a chromium-containing alloy.

The specification of United Kingdom Pat. No. 1,144,913 describes a solution for electroplating chromium, which includes chromium chloride contained in a dipolar aprotic solvent (such as dimethylformamide) and water. United Kingdom Pat. No. 1,333,714 describes another solution which includes chromium ammonium sulphate in a dipolar aprotic solvent and water.

However, such solutions possess limitations which hindered their industrial acceptance. In particular, parts of complex shapes could not be plated satisfactory and the poor electrical conductivity, due to the presence of the dipolar aprotic solvent, required a power supply capable of supplying up to 20 volts. Reduction in the quantity of the dipolar aprotic solvent resulted in an unsatable bath. In addition, the solution was relatively expensive. The plating solution also contained between 0.5 and 1.5 M chromium ions, a relatively high concentration. There are also health hazards associated with the use of dimethylformamide.

U.S. Pat. No. 3,917,517, claiming priority from United Kingdom patent application No. 47424/73, describes a chromium or chromium alloy electroplating solution comprising chromic chloride or sulphate having hypophosphite ions as a supplement to or replacement of the dipolar aprotic solvent disclosed in the last two mentioned United Kingdom patent specifications. The addition of hypophosphite ions to a trivalent chromium electroplating solution is said to "mitigate" or "overcome" many of the disadvantages of the solutions containing the dipolar aprotic solvent. However, the plating efficiency is stated to be lower than with high levels of the dipolar aprotic solvent and plating rates of 0.05 to 0.15 microns per minute, similar to the best rates available with the hexavalent chromic acid plating solutions, were obtained. Preferred range of temperature for plating is stated to be 25°±5° C. with a practical maximum being 35° C. for a chromic chloride solution and 55° C. for a chromic sulphate solution. The concentration of chromium was given as being 0.5 M to 1.75 M with a preferred range of 0.7 M to 1.3 M.

German Offenlegungsschrift Nos. 2,612,443 and 2,612,444, claiming priority from United Kingdom patent application Nos. 12774/75 and 12776/75, respectively, describe an aqueous electroplating solution comprising chromic sulphate having hypophosphite or glycine ions as "weak complexing agents" and chloride or fluoride ions, respectively. The maximum plating rate was again approximately 0.15 microns per minute and the preferred temperature range 25°-35° C. The preferred concentration of chromium for decorative plating was given as 1 M.

German Offenlegungsschrift No. 2,550,615, which corresponds to United Kingdom application No. 38320/72, also discloses a trivalent electroplating solution containing chromic sulphate or chloride, ammonium sulphate or chloride, boric acid, and a variety of alternative additional "weak complexing" materials, including glycine ions and hypophosphite ions. However, in the examples, the concentration of the additional buffer material was relatively high.

United Kingdom Pat. Nos. 1,445,580 and 1,455,841 described another approach that has been used to deposit chromium from aqueous solutions to trivalent salts. In these patents, the source of chromium ions was chromic chloride or chromic sulphate or chromic fluoride. In addition, bromide ions, ammonium ions and formate or acetate ions are stated to be essential. The plating rate was stated to be 0.15 microns per minute and a temperature in the range of 15°-30° C. The concentration of chromium was given as between 0.1 and 1.2 M, the preferred value being given as 0.4 M chromium ions.

SUMMARY OF THE INVENTION

The present invention provides a chromium or a chromium alloy electroplating solution in which the source of chromium comprises an aqueous equilibrated solution of a chromium(III) thiocyanate complex and a buffer material, the buffer material providing one of the ligands for the complex.

The buffer material is preferably an amino acid such as Glycine ($NH_2CH_2COOH$) or peptides which are amino acid polymers. The amino acids are strong buffering agents, but also are able to form, during equilibration, complexes with metal ions, such as chromium(III), by coordination through their nitrogen or oxygen atoms. Thus by equilibrating an amino acid with a chromium(III) thiocyanate complex, mixed amino acid chromium(III) thiocyanate complexes are formed.

DESCRIPTION OF THE PREFERRED EMBODIMENTS

In use, the electroplating solution of the present invention, having buffers which provide one of the ligands for a chromium(III) thiocyanate complex, has been found to have a number of highly desirable properties enhancing the catalytic characteristics of the chromium(III) thiocyanate plating solutions described above. First, the plating range can be extended and bright deposits have been produced over the range 10 to 1000+ ma/cm$^2$; second, plating rates of up to 0.9 microns per minute have been achieved; third, the temperature range over which bright chromium can be deposited is very wide, i.e., 20° to 70° C.; and fourth, the concentration of chromium ions in the solution can be kept very low.

It is believed that in earlier attempts to deposit chromium from trivalent solutions, plating was inhibited at high current densities by the deposition of a hydroxy chromium(III) species on the cathode. The deposition of chromium from the solution of the present invention is facilitated at high current densities, both by the catalytic effect of the thiocyanate and by the intimate buffering at the cathode by the amino acid released from the chromium atom as it discharges onto the cathode.

Other buffer materials could be used, such as formates, acetates, etc. However, the combination of the catalytic properties of thiocyanate and the intimate buffering of the complexed buffer material is what achieves the remarkable improvements provided by the present invention.

The chromium(III) thiocyanate complexes of the present invention may be chromium(III) sulphatothiocyante complexes or chromium(III) chlorothiocyanate complexes.

It will be clear that by the addition of nickel, cobalt or other metal salts to the solution, alloys of chromium and these metals can be plated. In addition, it will be understood that chromium and chromium alloys can be plated through photoresist masks.

The invention will now be described by way of example with reference to the following examples.

EXAMPLE I

Preparation of a plating solution according to the invention comprised of preparation of an 0.05 M aqueous solution of chromic chloride ($CrCl_3.6H_2O$).

The solution was saturated with 50 g/liter of boric acid ($H_3BO_3$) and equilibrated at 80° C. for one hour with 0.75 M sodium thiocyanate (NaNCS), 0.16 M glycine ($NH_2CH_2COOH$), 0.5 M potassium chloride (KCl) and 2 M potassium bromide. The potassium chloride and bromide were added to improve the conductivity of the solution. The equilibrated solution was cooled, its pH adjusted to 3.0 by the addition of dilute sodium hydroxide and 1 gram/liter sodium lauryl sulphate (wetting agent) was added.

The plating solution was introduced into a Hull cell having a flat platinized titanium anode and a flat brass Hull cell test cathode. No ion exchange membrane was used to separate the anode and cathode, and the temperature of the solution was 22° C. A plating current of 5 A was passed through the solution for two minutes. Bright chromium was deposited from 10 mA/cm$^2$ to the top of the plate (580+ mA/cm$^2$).

EXAMPLE II

To illustrate the effect of equilibrating glycine with chromium(III) thiocyanate producing an aqueous equilibrated mixed glycine chromium(III) sulphato thiocyanate complex solution, a solution was prepared in the following stages:

A. A plating solution was prepared by providing a 0.075 M chromic sulphate solution ($Cr(SO_4)_3.15H_2O$). The solution was saturated with 80 grams/liter of boric acid ($H_3BO_3$) and equilibrated at 80° C. for one hour with 0.15 M sodium thiocyanate and 0.8 M sodium sulphate. The sodium sluphate was added to improve the conductivity of the solution. The equilibrated solution was cooled, its pH adjusted to 2.5 by the addition of dilute sodium hydroxide and 0.6 grams/-liter sodium lauryl sulphate (wetting agent) was added.

This plating solution was introduced into a standard Hull cell, as in Example I, and the temperature of the solution was maintained at 20° C. A plating current of 5 A was passed for two minutes. Bright chromium was deposited on the Hull cell plate from 5 mA/cm$^2$ to 125 mA/cm$^2$.

B. The solution prepared in Step A above was reequilibrated at 80° C. for one hour with the addition of 5 grams/liter of glycine (0.065 M). The pH was adjusted to 2.5 by the addition of dilute sodium hydroxide.

A current of 5 A was passed through solution B at a temperature of 25° C. in a standard Hull cell for two minutes. Bright chromium was deposited over the range 5 to 275 mA/cm$^2$.

C. The solution prepared in Step A above was reequilibrated at 80° C. for one hour with the addition of 10 grams/liter of glycine (0.13 M). The pH was adjusted to 2.6 by the addition of dilute sodium hydroxide. A current of 1.6 A was passed through solution C at a temperature of 47° C., using a 12 cm$^2$ cathode (130 mA/cm$^2$) for thirty minutes. A chromium depost 10 microns thick was deposited (i.e., 0.33 microns per minute).

D. The effect of temperature is illustrated by the following: Solution B was heated to 45° C. and a current of 5 A was again passed through the solution in a standard Hull cell for two minutes. Bright chromium was now found to be deposited from 12 mA/cm$^2$ to 400 mA/cm$^2$.

EXAMPLE III

A plating solution was prepared substantially as described in Example I of the instant inventor's U.S. patent application Ser. No. 913,639, i.e., 150 grams of sodium dichromate ($Na_2Cr_2O_7$) was added to 485 mls of perchloric acid ($HClO_4$) and 525 mls water. About 400 mls hydrogen peroxide was added in drop-wise fashion until the solution became deep blue. When this state was reached, the solution was boiled down to half its volume, driving off hydrogen peroxide and leaving the required solution of chromium perchlorate $Cr(ClO_4)_3$. This solution provided a source solution of chromium-(III) for plating.

Ten grams of glycine were dissolved in water and the pH adjusted to 2.0 with perchloric acid. 100 mls of the chromium source solution was added to the glycine solution, the pH of which was again adjusted to 2.0 with sodium hydroxide solution and the volume adjusted to 1 liter by the addition of water. This solution was equilibrated with sodium thiocyanate (0.3 M) and sodium perchlorate (1 M) for one hour at 80° C. The solution was cooled to 40° C., saturated with 70 grams/liter of boric acid ($H_3BO_3$), and 1 gram/liter of sodium lauryl sulphate was added.

The following plating results were obtained with the solution prepared in Example III.

A. Bright chromium could be deposited at temperatures in the range 25° C. to 70° C. The best results were attained at temperatures above 35° C.

B. The solution was introduced into a Hull cell and heated to 70° C. A brass Hull cell cathode was plated at a total current of 10 A for two minutes, using a flat platinized titanium anode. Bright chromium was deposited on the brass plate from the 20 mA/cm$^2$ position to the top of the plate (1000+ mA/cm$^2$). There was no sign of burning or poor deposit.

C. The solution was heated to 70° C. and a 6.3 mm diameter brass rod was plated at 300 mA/cm$^2$ for ten minutes, the rod being agitated during plating. The thickness of the chromium deposit, measured by weighing, was 9 microns.

D. The solution was heated to 70° C. and a 6.3 mm diameter brass rod was plated at 135 mA/cm$^2$ for ten minutes, the rod being agitated during plating. The thickness of the chromium deposit, measured by weighing, was 6 microns.

EXAMPLE IV

A plating solution was prepared as in Example II-C, except that 1 M sodium perchlorate was used to improve the conductivity of the solution in place of the 0.8 M sodium sulphate. A bright chromium deposit 0.85 microns thick was plated on both sides of a brass strip 2×5 cm, under the following conditions: ph=2.55, temperature 46° C., current 2A, and time 2.5 minutes. The current density was 100 mA/cm$^2$ and the chromium was deposited at 0.3 microns/minute.

EXAMPLE V

Preparation of another plating solution according to the present invention involves the following steps (the amounts of the constituents are for 1 liter of plating solution):

A. 60 grams of boric acid ($H_3BO_3$) is added to 600 ml of deionized or distilled water. The solution is heated and stirred until dissolved. The pH is adjusted to between 2 and 2.4 with 10% NaOH or 10% $H_2SO_4$.

B. 33.12 grams of chromium(III) sulphate ($Cr_2(SO_4)_3.15H_2O$) is added to the boric acid solution prepared in Step A above.

C. 32.43 grams sodium thiocyanate (NaSCN) is added to the solution made in Step B. The mixture is heated and maintained at 85° C.±5° C. It is stirred for ninety minutes.

D. The solution is cooled to room temperature. 10 grams of glycine ($NH_2.CH_2COOH$) are added to the solution. The pH is adjusted as in Step A. The solution is heated and maintained at 85° C.±5° C., stirring for ninety minutes.

E. The solution is cooled to room temperature and 140 grams of sodium perchlorate ($NaClO_4.H_2O$) are added. The mixture is heated and stirred until dissolved.

F. The pH is adjusted as in Step A.

G. The solution is brought up to one liter with distilled or deionized water.

H. 1 gram of sodium lauryl sulphate or 1 gram of FC98 is added and the solution is stirred to dissolve. The solution is then ready for plating.

(FC98 is a wetting agent and a product of the 3M Corporation.)

Suitable plating conditions are as follows.

The bath can be operated over a range of current density, pH and temperature. Suitable conditions are 50–150 mA/cm$^2$, pH 2.0–4.0 and temperature 25°–60° C. At 105 mA/cm$^2$, pH 3.5 and temperature 50° C., 0.6 microns chromium is deposited in two minutes (20–23% efficiency).

The anode current density should be maintained at about 40 mA/cm$^2$. The anodes can be of platinized titanium or carbon.

Fume extraction should be used as small electrochemical breakdown of the thiocyanate anion occurs at the cathode.

EXAMPLES VI and VII

A plating solution was prepared as in Example V, except that the ligand buffer glycine was replaced by glycilglycine (GLY.GLY) in one case and glycilglycilglycine (GLY.GLY.GLY) in the other (diglycine and triglycine, respectively). The concentration of each ligand buffer was varied between 1 gram/liter and 20 grams/liter. Bright plating was obtained over this range. The efficiency increased from 11% at 1 gram/liter to 16% at 10 grams/liter and decreased to 5% at 20 grams/liter.

EXAMPLE VIII

A plating solution was prepared as in Example V, except that the quantity of NaSCN was reduced to 16.2 grams and glycilglycine was substituted for glycine. The concentration of glycilglycine was varied from 1 gram/liter to 5 grams/liter. Bright plating was obtained with efficiencies similar to those obtained in Example VI.

EXAMPLE IX

A plating solution was prepared as in Example V, except that the ligand buffer glycilglycine was added to the solution already containing 10 grams of the ligand buffer glycine. The concentration of glycilglycine was varied from 1 gram to 5 gram per liter. Bright plating was obtained with the efficiency decreasing from 19% to 13.5% with increasing concentration of glycilglycine in the range of 1–5 grams/liter.

EXAMPLE X

A plating solution was prepared as in Example IX, except that the quantity of NaSCN was reduced to 16.2 grams. The efficiency decreased from 15% to 13.5% with increasing concentration of glycilglycine in the range of 1–5 grams/liter. Bright plating was obtained over this range.

EXAMPLE XI

A plating solution was prepared as in Example V, except that the quantity of NaSCN was reduced to 16.2 grams/liter and aspartic acid at a concentration of 0.05 M was substituted for the ligand buffer glycine. This produced good bright plating over a wide range 10 mA/cm$^2$ to 500+ mA/cm$^2$ and an efficiency of 23% was obtained.

EXAMPLE XII

The concentration of aspartic acid in Example XI was increased to 0.1 M. Bright plating produced complete cover over a 10 A Hull cell plate. Plating could be carried out up to a temperature of 80° C. at an efficiency of 23%.

EXAMPLE XIII and XIV

A plating solution was prepared as in Example V, except that the ligand buffer glycine was replaced by argnine in one case and by histidine in the other and the quantity of NaSCN was reduced to 16.2 grams/liter. With both arginine and histidine, bright plating was achieved at concentrations of 0.05 M and an efficiency of 13.8% was obtained.

EXAMPLE XV

A plating solution was prepared as in Example V, except that the quantity of NaNCS was reduced to 16.2 grams and sodium acetate ($CH_3.COO\ Na$) was substituted for the ligand buffer glycine. The concentration of sodium acetate was 8.2 grams/liter i.e., 0.1 M. The solution produced bright clean deposits over the range 5 mA/cm$^2$ up to approximately 600 mA/cm$^2$ with an efficiency of 14%. In this example, the solution temperature was 40° C. and had a pH of 2.5.

EXAMPLE XVI

A plating solution was prepared as in Example V, except that the quantity of NaNCS was reduced to 16.2 grams and sodium formate (H.COO Na) was substituted for the ligand buffer glycine. The concentration of sodium formate was 6.8 grams/liter, i.e., 0.1 M. The solution produced bright clean deposits over the range 5 mA/cm$^2$ up to approximately 600 mA/cm$^2$ with an efficiency of 14%. In this example, the solution temperature was 40° C. and had a pH of 2.5.

EXAMPLE XVII

A plating solution was prepared as in Example V, except that the quantity of NaNCS was reduced to 16.2 grams and sodium hypophosphite ($NaH_2PO_2$) was substituted for the ligand buffer glycine. The concentration of sodium hypophosphite was 8.8 grams/liter, i.e., 0.1

M. The solution produced bright clean deposits over the range 15 mA/cm$^2$ up to approximately 300 mA/cm$^2$ with an efficiency of 14%. In this example, the solution temperature was 40° C. and had a pH of 2.5.

What is claimed is:

1. In a solution for electroplating chromium in which the source of chromium ions is an aqueous equilibrated solution of chromium(III) thiocyanate complex, the improvement which comprises, a buffer material in the solution, which buffer material provides one of the ligands for the complex, said buffer material being selected from the group consisting of amino acids, peptides, formates, acetates and hypophosphites.

2. The invention as defined in claim 1 where the buffer material is an amino acid.

3. The invention as defined in claim 2 wherein the amino acid is glycine.

4. The invention as defined in claim 2 wherein the amino acid is aspartic acid.

5. The invention as defined in claim 2 wherein the amino acid is arginine.

6. The invention as defined in claim 2 wherein the amino acid is histadine.

7. The invention as defined in claim 1 wherein the buffer includes as amino acid and a peptide.

8. The invention as defined in claim 7 wherein the amino acid is glycine.

9. The invention as defined in claim 7 wherein the peptide is diglycine.

10. The invention as defined in claim 7 wherein the amino acid is glycine and the peptide is diglycine.

11. The invention as defined in claim 1 wherein the buffer is a peptide.

12. The invention as defined in claim 11 wherein the peptide is diglycine.

13. The invention as defined in claim 11 wherein the peptide is triglycine.

14. The invention as defined in claim 1 wherein the acetate is sodium acetate.

15. The invention as defined in claim 1 wherein the formate is sodium formate.

16. The invention as defined in claim 1 wherein the hypophosphite is sodium hypophosphite.

17. In a method of plating chromium wherein an aqueous equilibrated solution of chromium(III) thiocyanate complex provided the source of chromium and wherein a current is passed through the solution to cause electrodeposition of chromium, the improvement which comprises, providing a buffer material in the solution, which buffer material provides one of the ligands for the complex, said buffer material being selected from the group consisting of amino acids, peptides, formates, acetates and hypophosphites.

18. The invention as defined in claim 17 wherein the buffer material is an amino acid.

19. The invention as defined in claim 18 wherein the amino acid is glycine.

20. The invention as defined in claim 18 wherein the amino acid is aspartic acid.

21. The invention as defined in claim 18 wherein the amino acid is arginine.

22. The invention as defined in claim 18 wherein the amino acid is histadine.

23. The invention as defined in claim 17 wherein the buffer includes an amino acid and a peptide.

24. The invention as defined in claim 23 wherein the amino acid is glycine.

25. The invention as defined in claim 23 wherein the peptide is diglycine.

26. The invention as defined in claim 23 wherein the amino acid is glycine and the peptide is diglycine.

27. The invention as defined in claim 17 wherein the buffer is a peptide.

28. The invention as defined in claim 27 wherein the peptide is diglycine.

29. The invention as defined in claim 27 wherein the peptide is triglycine.

30. The invention as defined in claim 17 wherein the acetate is sodium acetate.

31. The invention as claimed in claim 17 in which the formate is sodium formate.

32. The invention as claimed in claim 17 in which the hypophosphite is sodium hypophosphite.

* * * * *